US007192635B2

(12) United States Patent
Ott

(10) Patent No.: US 7,192,635 B2
(45) Date of Patent: Mar. 20, 2007

(54) U-SHAPED THERMOPLASTIC HAIR-CONNECTING ELEMENT

(75) Inventor: Gerhard Ott, Graz (AT)

(73) Assignee: Bege Privatstiftung, Wien (AT)

( * ) Notice: Subject to any disclaimer, the term of this patent is extended or adjusted under 35 U.S.C. 154(b) by 91 days.

(21) Appl. No.: 10/742,975

(22) Filed: Dec. 23, 2003

(65) Prior Publication Data

US 2004/0170805 A1 Sep. 2, 2004

(30) Foreign Application Priority Data

Dec. 23, 2002 (AT) ..... A 1929/2002

(51) Int. Cl.
*A41G 5/00* (2006.01)

(52) U.S. Cl. ..... 428/122; 132/53; 132/201; 132/270

(58) Field of Classification Search ..... 428/122; 132/53, 201, 270
See application file for complete search history.

(56) References Cited

U.S. PATENT DOCUMENTS 4,522,521 A * 6/1985 Scott ..... 400/691
5,937,867 A * 8/1999 Williams ..... 132/201

FOREIGN PATENT DOCUMENTS

AT 403427 * 7/1997

* cited by examiner

*Primary Examiner*—Alexander S. Thomas
(74) *Attorney, Agent, or Firm*—Buchanan Ingersoll & Rooney PC

(57) ABSTRACT

A U-shaped thermoplastic hair-connecting element is provided with at least one intermediate partition disposed between parallel legs of the U-shaped element. The intermediate partition can be designed as a longitudinal partition which runs essentially parallel to the legs and which projects from a connector of the U-shaped element. Alternatively, the intermediate partition can be a transverse partition which runs essentially transverse to the legs and perpendicular to the connector which connects the legs to one another. There can also be provided longitudinal partitions together with transverse partitions. Foreign hairs can be embedded into the hair-connecting element either during manufacturing, or in a separate manufacturing step.

8 Claims, 2 Drawing Sheets

U-SHAPED THERMOPLASTIC HAIR-CONNECTING ELEMENT

This application claims priority under 35 U.S.C. § 119 to patent application Ser. No. A-1929/2002 filed in Austria on Dec. 23, 2002, the entire content of which is incorporated by reference.

BACKGROUND OF THE INVENTION

The invention relates to a U-shaped thermoplastic hair-connecting element and method of using same. Such elements are already known from prior art in the most differs variations. The legs of the U-shaped element are normally parallel to each other and straight. The connecting piece connecting said legs is either straight or curved. The ends of foreign hairs (i.e., hairs other than the user's scalp hairs) are embedded in such an element, specifically in the legs, in the connecting piece, or in the connecting piece and the legs as well. This is achieved through coating or dipping of hairs in softened synthetic material and by subsequent pressing said elements into a specific shape. Prefabricating of the hair-connecting element with subsequent clamping of foreign hairs is known in the art as well. Strands of scalp hair are inserted with their ends between the legs of the U-shaped element during the application of strands of foreign hair provided with the U-shaped thermoplastic hair-connecting element whereby said U-shaped element is subsequently heated by means of ultrasound or by means of heated tweezers, and said U-shaped element is the pressed together so that a molten adhesive connection is created whose shape depends on the shape of the clamping element.

Experience in the use of such U-shaped hair-connecting elements has shown that the scalp hair, or even the foreign hair, is often times not sufficiently or completely coated in the course of molten adhesion, which leads to separation of the foreign hair, especially during combing.

SUMMARY OF THE INVENTION

The object of the invention is a hair-connecting element which does not have the disadvantage stated above and which ensures thereby an optimal molten adhesive connection.

This object is achieved according to the invention with a U-shaped thermoplastic hair-connecting element in that at least one intermediate partition is provided between the legs of the U-shaped element.

There is not only a larger amount of plastic material made available altogether for molten adhesion but material is made available also in specific locations where there was no such material present in the use of U-shaped hair-connecting elements of prior art. The penetration of spaces between hairs or the coating of the foreign hair and the scalp hair to be connected is improved thereby.

The intermediate partition can be designed as a longitudinal partition which runs essentially parallel to the legs of the U-shaped element and which projects from its connecting piece. Foreign hairs can be embedded with their ends in a longitudinal partition of this type in addition to the legs and/or to the connecting piece of the U-shaped element so that a denser strand of foreign hair can be applied per molten adhesion.

The intermediate partition can also be designed as a transverse partition, which runs essentially transverse relative to the legs and perpendicular to the connecting piece of the U-shaped element and which connects said legs to one another. In this case, each transverse partition is placed under relatively high pressure during the course of pressing the hair-connecting element together during the process of molten adhesion so that the softened synthetic material encases the individual hair ends in a very complete manner.

One embodiment is especially preferred in which at least two intermediate partitions are provided of which at least one longitudinal partition is designed to run essentially parallel between the legs of the U-shaped element and project from its connecting piece, and whereby at least one transverse partition is designed to connect the legs and to stand perpendicular relative to said connecting piece. This embodiment combines the advantages of longitudinal partitions and transverse partitions.

It is favorable if each longitudinal partition projects past the legs. This is favorable since a divided strand of scalp hair on the human head is inserted at both sides of each longitudinal partition into the U-shaped element during application of the strands of foreign hair provided with the hair-connecting element. The protruding longitudinal partition contributes substantially to the interlocking of the previously open U-shaped element after pressing the hair-connecting element together, which results in a very reliable molten adhesion.

The legs of the U-shaped element should project past each existing transverse partition so that scalp hairs can be securely inserted between the legs and guided by these legs during application of the strands of foreign hair.

DESCRIPTION OF THE DRAWINGS

The invention is described in more detail in the following with the aid of embodiment examples illustrated in the drawings.

DETAILED DESCRIPTION OF A PREFERRED EMBODIMENT OF THE INVENTION

Figure 1:
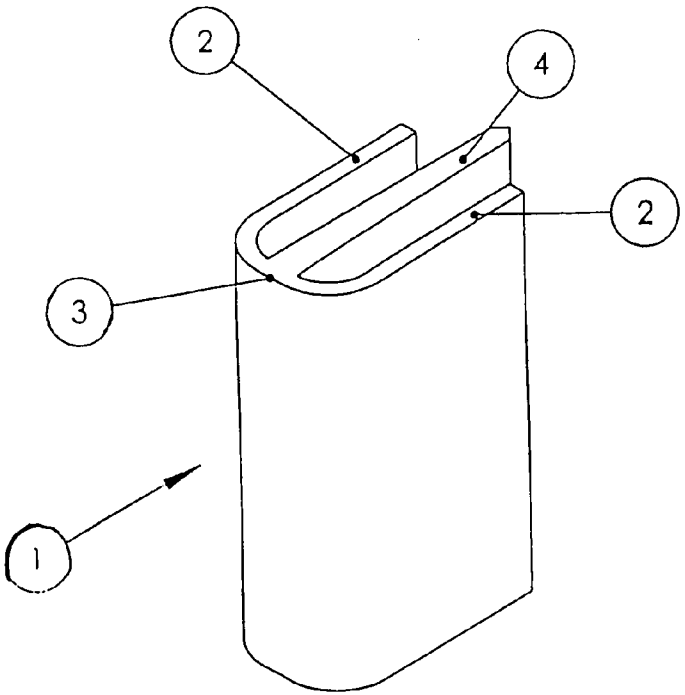
FIG. 1 shows a U-shaped thermoplastic hair-connecting element according to the invention.

The U-shaped thermoplastic hair-connecting element 1 in FIG. 1 has two parallel legs 2 connected by a connecting piece 3 that is bent into a semicircular shape. An intermediate partition projects from the connecting piece 3 designed as a longitudinal partition 4, which runs parallel to the legs 2 and projects past said legs. Foreign hairs (not illustrated) can be embedded with their ends in the legs 2, the connecting piece 3 and the longitudinal partition 4 either during the course of manufacturing of the hair-connecting element 1 or during a separate manufacturing step. A strand of scalp hair on the human head (not illustrated) is inserted into the spaces between the legs 2 and the longitudinal partition 4 in the application of such a hair-connecting element 1 provided with a strand of foreign hair. The hair-connecting element 1 is subsequently deformed with or without influence of heat whereby there occurs molten adhesion of the foreign hair to the scalp hair. Pressure is thereby applied primarily onto the connecting piece and the projecting longitudinal partition so that the latter "flows" to both sides and completely encases the scalp hair.

Figure 2:
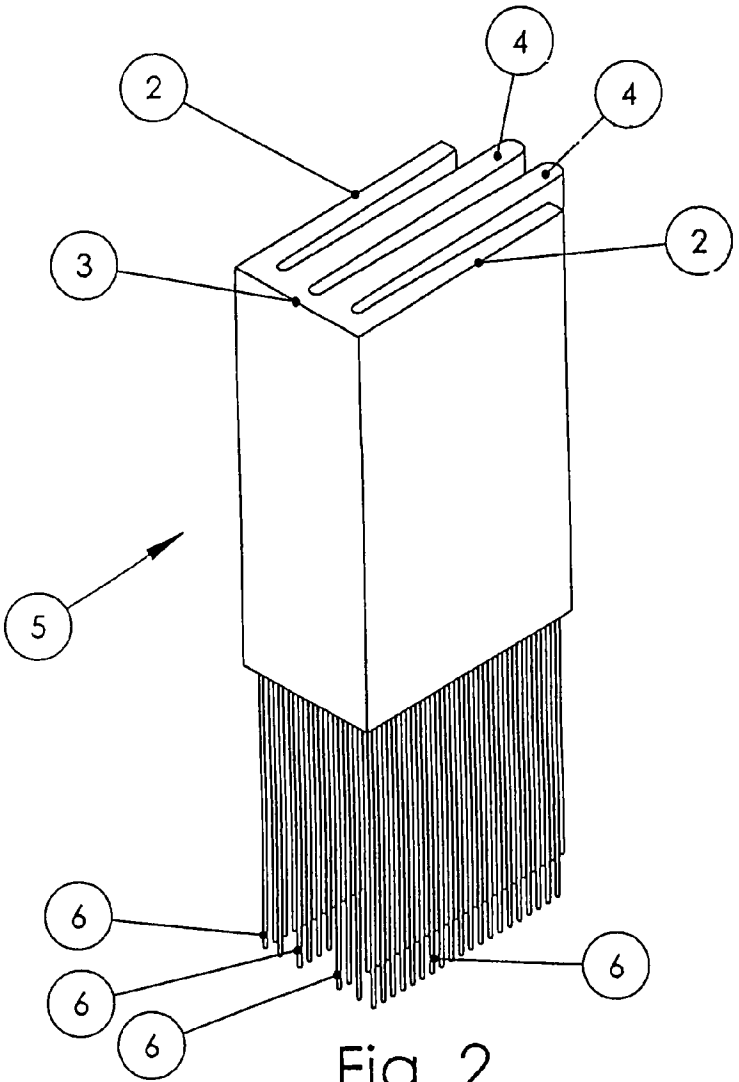
FIG. 2 shows another embodiment of said hair-connecting element having already embedded foreign hairs.

FIG. 2 shows a hair-connecting element with already embedded foreign hairs 6, which is provided with two longitudinal partitions 4 between the legs 2 and whose connecting piece 3 is straight. Foreign hairs 6 are forced with their respective ends into the legs 2 and the longitudinal partitions 4. The application of the hair-connecting element 5 is the same as for the hair-connecting element 1 described above.

Figure 3:
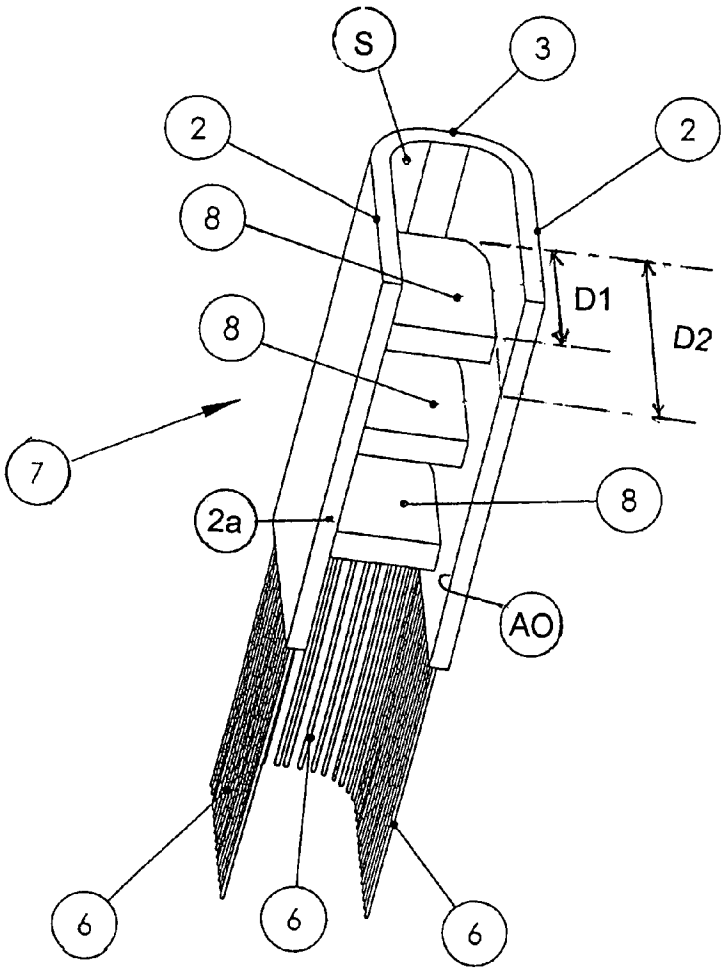

FIG. 3 shows a hair-connecting element 7 having three intermediate partitions designed as transverse partitions 8. Each transverse partition 8 projects thereby perpendicular from the connecting piece 3 and connects the two legs 2, the legs defining therebetween a space S which has an access opening AO disposed between outer free ends 2*a* of the legs. The legs 2 project past the transverse partitions 8 and the connecting piece 3 is essentially straight, for example, with rounded transitions to said legs 2. The partitions are located closer to the connecting piece than to free ends 2*a* of the legs 2, as shown in FIG. 3 (and in FIG. 4). Each transverse partition 8 extends from an interior surface 3*a* of the connecting piece 3 by a distance D1 which is more than one-half of a distance D2 from the surface 3*a* to the free ends 2*a* of the legs 2. Already embedded foreign hairs 6 are shown which are disposed with their ends in the legs 2 and the connecting piece 3. In this application, the scalp hairs (not illustrated) are inserted into the U-shaped element from above (relative to FIG. 3) and approximately parallel to the foreign hairs 6 so that they rest against the face of the transverse partitions 8. The hair-connecting element 7 is subsequently pressed together (through pressure with or without influence of heat) whereby molten adhesion is achieved and whereby the transverse partitions 8 are made to "flow" to a relatively large degree to encase thereby the scalp hairs in a complete manner.

Figure 4:
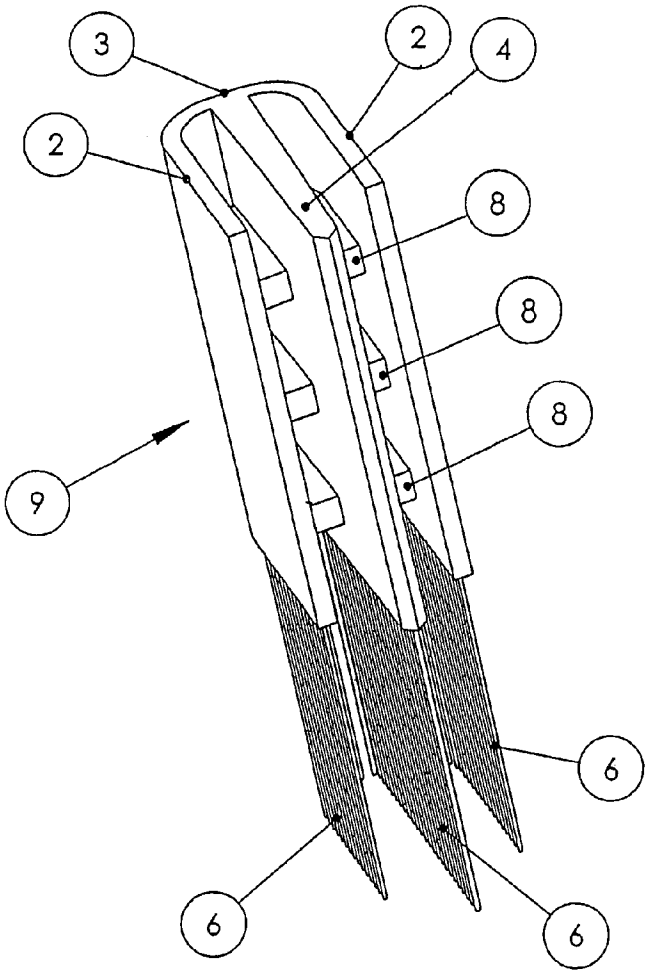
FIGS. 3 and 4 show additional embodiments of the hair-connecting element having embedded foreign hairs.

FIG. 4 finally shows a hair-connecting element that has one longitudinal partition 4 as well as three transverse partitions 8, for example. Foreign hairs have been embedded in this embodiment, for example, only in the legs 2 and in the longitudinal partition 4, but not in the connecting piece 3. The application of this hair-connecting element 9 is the same as already described above. The obtainable molten adhesion combines the advantages of the longitudinal partitions 4 and the transverse partitions 8.

Although the present invention has been described in connection with preferred embodiments thereof, it will be appreciated by those skilled in the art that additions, deletions, modifications, and substitutions not specifically described may be made without departing from the spirit and scope of the invention as defined in the appended claims.

What is claimed is:

1. A thermoplastic hair-connecting element, comprising a generally U-shaped portion formed by two spaced-apart legs joined by a connector, and at least one intermediate partition disposed between the legs, wherein the intermediate partition comprises a transverse partition extending transversely to the legs and perpendicular to the connector and which connects said legs to one another, the transverse partition extending from an interior surface of the connector by a distance of more than one-half a distance from such interior surface to outer free ends of the legs.

2. The hair-connecting element according to claim 1, wherein the legs project past the transverse partition.

3. The hair-connecting element according to claim 1 wherein the partition is situated closer to the connector than to free ends of the legs.

4. A method of connecting foreign hair to scalp hair comprising the steps of:

A. providing a thermoplastic hair-connecting element comprising a generally U-shaped portion formed by two spaced apart legs joined by a connector, the legs forming therebetween a space and including outer free ends facing away from the connector, the space having an access opening formed between the outer free ends of the legs, and at least one intermediate partition disposed in the space between the legs;

B. embedding foreign hair in the element;

C. inserting scalp hair through the access opening and into the space; and

D. while the portion of the scalp hair within the space is exposed to the access opening, deforming the element by pressing the legs together to encase the scalp hair in the element by molten adhesion.

5. A thermoplastic hair-connecting element, comprising a generally U-shaped portion formed by two spaced-apart legs joined by a connector, and at least two intermediate partitions disposed between the legs, wherein at least one of the partitions constitutes a longitudinal partition extending substantially parallel to the legs and projecting from the connector, and at least one of the partitions constitutes a transverse partition connecting the legs together and extending perpendicular to the connector.

6. The hair-connecting element according to claim 5, wherein the longitudinal partition projects past the legs.

7. The hair-connecting element according to claim 5, wherein the legs project past the transverse partition.

8. A thermoplastic hair-connecting element, comprising a generally U-shaped portion formed by two spaced-apart legs joined by a connector, and at least one intermediate partition disposed between the legs, wherein the at least one intermediate partition includes a longitudinal partition extending substantially parallel to the legs and which projects from the connector and past the legs.

* * * * *